US005986645A

United States Patent [19]

Brooks

[11] Patent Number: 5,986,645

[45] Date of Patent: Nov. 16, 1999

[54] JOYSTICK WITH IMPROVED ACTUATOR

[75] Inventor: Edward F. Brooks, Skokie, Ill.

[73] Assignee: H. Betti Industries, Inc., Carlstadt, N.J.

[21] Appl. No.: 08/993,620

[22] Filed: Dec. 18, 1997

[51] Int. Cl.[6] ..... G09G 5/08

[52] U.S. Cl. ..... 345/161; 345/173; 345/157

[58] Field of Search ..... 345/161, 173, 345/157; 200/6 A, 6 R; 74/741 XY, 741 R

[56] References Cited

U.S. PATENT DOCUMENTS

| | | | |
|---|---|---|---|
| 3,115,555 | 12/1963 | Lescarboura . | |
| 4,473,725 | 9/1984 | Kim | 200/6 A |
| 5,043,709 | 8/1991 | Kim | 340/709 |
| 5,068,498 | 11/1991 | Engel | 200/6 A |
| 5,140,313 | 8/1992 | Wen | 340/709 |
| 5,157,229 | 10/1992 | Wu | 200/6 A |
| 5,406,040 | 4/1995 | Johnson | 200/6 A |

OTHER PUBLICATIONS

"WICO Gives You The Most" brochure believed to have been published prior to Dec. 18, 1997.

*Primary Examiner*—Richard A. Hjerpe
*Assistant Examiner*—Kimnhung Nguyen
*Attorney, Agent, or Firm*—Brinks Hofer Gilson & Lione

[57] ABSTRACT

An improved joystick is disclosed having an actuator that is resistant to undesired rotation stemming from rotation of the handle of the joystick during use.

10 Claims, 1 Drawing Sheet

JOYSTICK WITH IMPROVED ACTUATOR

BACKGROUND OF THE INVENTION

The present invention relates to joysticks of the type used with electronic equipment, such as video games. More particularly, the present invention relates to a joystick having an improved actuator for reducing wear and improving performance of the joystick.

Joysticks are commonly made up of a shaft extending through, and pivotally mounted in, a base. The base will often have multiple switches disposed about the shaft so that an actuator attached to the end of the shaft will actuate the switches when the shaft is pivoted in the base. The switches are typically configured to generate electrical signals corresponding to a direction of movement of the shaft of the joystick such that the movement of the handle of the joystick is replicated and translated to a desired object or image (for example, a video image in a video game).

U.S. Pat. No. 5,068,498 discloses one version of a joystick known in the industry. In this particular joystick, an actuator positioned on the end of the shaft adjacent the switches is held onto the shaft by a clip. A spring coaxial with the shaft, and positioned on the opposite side of the actuator, presses the actuator against the clip. A drawback of this design is that the actuator will rotate with rotation of the shaft. Rotation of the actuator may lead to accidental actuation of one or more switches in contrast with an intended actuation based on pivotal movement of the shaft within the base.

One attempt to solve the problem of undesirable rotation of the actuator with the shaft is disclosed in U.S. Pat. No. 5,406,040. This patent discloses a joystick having a separate sleeve positioned over the end of the shaft around which an actuator is mounted. A clip holds the sleeve in an axially fixed position on the end of the shaft. Although the sleeve may provide a lower coefficient of friction for the actuator, the use of an additional sleeve increases the complexity and manufacturing difficulties required in producing the joystick.

SUMMARY OF THE INVENTION

According to a first aspect of the invention, a joystick is provided that overcomes the disadvantage of prior joysticks and provides the feature of a free slip actuator that may rotate separately from rotational movements by the shaft of the joystick.

A preferred joystick includes a base, a plurality of switches disposed on the base, and a shaft pivotally associated with the base. The shaft includes a handle end and an actuator end. The shaft includes a pivot assembly having a biasing member held in an axially fixed position by a first retaining member affixed to the shaft. An actuator disposed on the actuator end of the shaft has an axial dimension smaller than an axial dimension defined by the distance between the first retaining member and a second retaining member on the end of the shaft.

DETAILED DESCRIPTION OF A PRESENTLY PREFERRED EMBODIMENT

Figure 1:
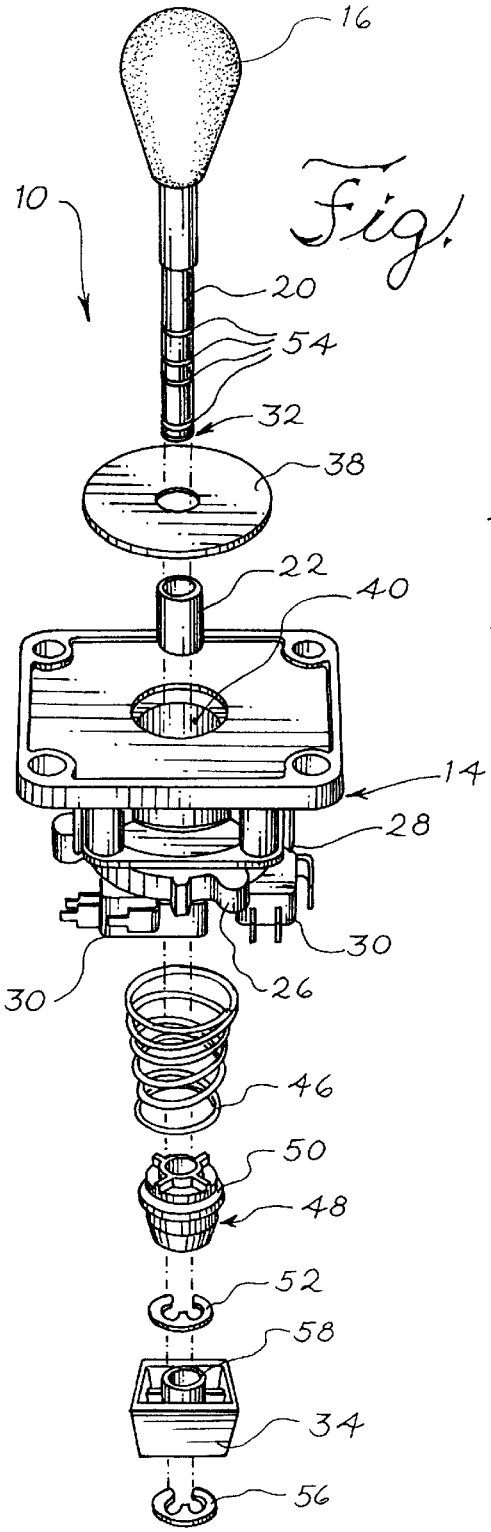
FIG. 1 is an exploded perspective view of a preferred embodiment of the improved joystick according to the present invention.
Figure 2:
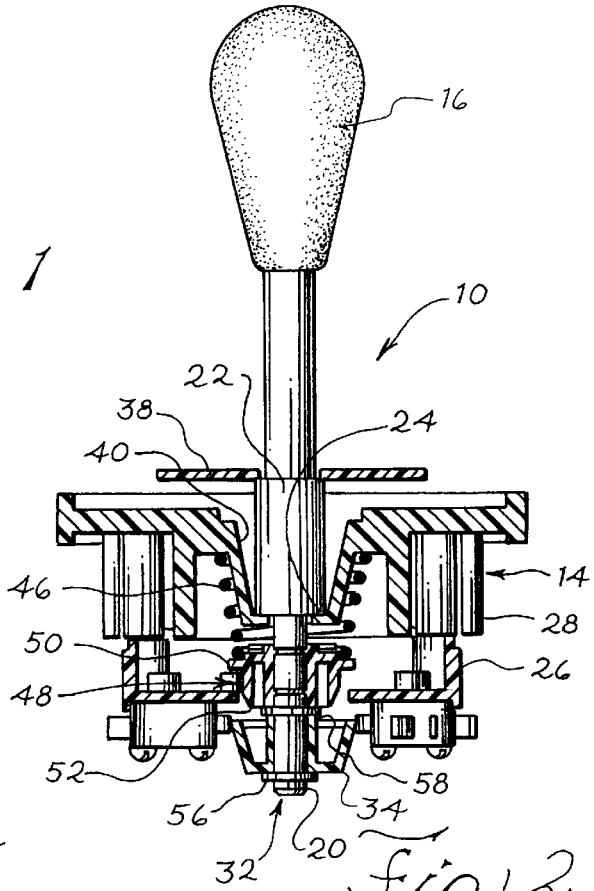
FIG. 2 is a cross-sectional view of the fully assembled version of the joystick shown in FIG. 1.
Figure 3:
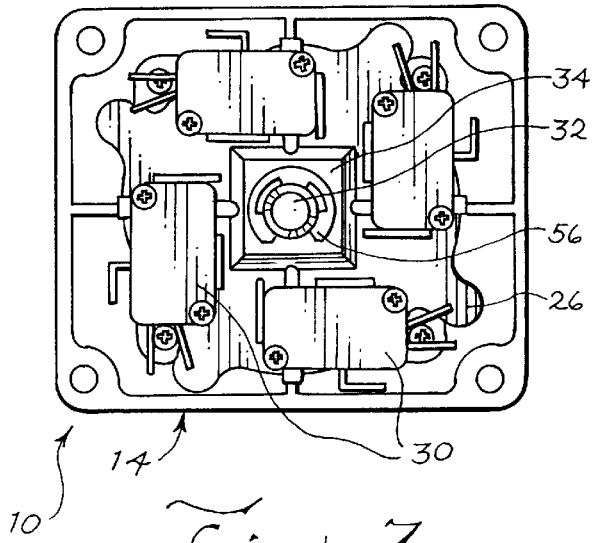
FIG. 3 is a bottom plan view of the joystick of FIG. 2.

FIGS. 1–3 illustrate a joystick 10 according to a preferred embodiment of the present invention. The joystick 10 includes a shaft assembly 12 pivotally mounted in a base assembly 14. The shaft assembly 12 includes a handle portion 16 and a sleeve 18 affixed to the upper end of the shaft 20. A shaft pivot assembly holds the shaft against the base and facilitates pivotal motion of the shaft. The shaft pivot assembly preferably includes a pivot sleeve 22 that is slidably and coaxially mounted on the shaft 20. The pivot sleeve 22 acts as a fulcrum, as explained in greater detail below, to transfer pivotal motion of the handle 16 down the shaft 20.

The lower portion of the shaft assembly 12 passes through a conical cavity 40 in the base assembly 14. The base assembly includes a switch carrying plate 26 removably attached to a switch plate mount 28. The switch carrying plate 26 preferably holds a plurality of switches 30 disposed about the actuator end 32 of the shaft 20. An actuator 34 is mounted on the actuator end 32 of the shaft 20 in a manner that allows the actuator to contact one or more of the switches 30 when a user pivots the handle 16 of the joystick 10.

The shaft pivot assembly of the joystick 10 and the freely rotatable feature of the actuator 34 with respect to the shaft 20 are best shown in FIG. 2. As shown in FIG. 2, the shaft 20 passes through a circular plate 38. The shaft continues on through the conical cavity 40 in the base 14. The pivot sleeve 22 has a greater outer diameter than the diameter of a bore 24 extending through the base 14 of the cylindrical cavity 40. Preferably, the bore 24 has a diameter greater than the diameter of the shaft 20. Underneath the base 14, and outside the cylindrical cavity 40, a biasing member 46 is positioned coaxially around the cylindrical cavity 40, and compressed against the bottom of the base 14. An axial stop 48 positioned coaxially on the shaft towards the actuator end 32 holds the biasing member against the base 14. The axial stop has a flange 50 with a diameter greater than the diameter of the biasing member 46. The axial stop 48 is held in an axially fixed position between a clip 52, such as an E-ring, mounted in a receiving groove 54 and the biasing member 46. The biasing member 46 may be a spring held in compression between the bottom of the base 14 and the flange 50 of the axial stop 48. The actuator 34 is positioned on the actuator end 32 of the shaft 20 between the clip 52 and a second clip 56 mounted in another receiving groove 54 on the shaft 20. Preferably, the actuator 34 has an axial dimension that is smaller than the axial dimension defined by the distance between the first and second clips 52, 56. The actuator 34 also has an axial bore 58 with an inner diameter slightly greater than the diameter of the shaft 20.

An advantage of the configuration of the joystick 10 is that any rotational force imparted on the handle 16 that rotates the shaft 20 will have little or no effect on the actuator 34 mounted loosely between the clips 52, 56. The presently preferred joystick 10 is configured to avoid any axial loading of the actuator 34 by the biasing member 46 and divert it to the first clip 52. The slightly greater diameter of the actuator bore and freedom from axial pressure provide for independent rotational ability. Additionally, because each of the first and second clips 52, 56 may be a commonly available E-ring, the need for special sleeves or customized parts is eliminated. In one embodiment, the shaft 20 may be adjustable in length. The length of the shaft protruding from the base can be changed by providing appropriately spaced receiving grooves 54 that permit positioning of the actuator 34 and axial stop along a different section of the shaft. The clips 52, 56 can simply be placed in the desired receiving grooves to adjust the shaft length for different mounting requirements.

FIG. 3 illustrates one preferred configuration of switches 30 on the switch carrying plate 26. The actuator 34, which may have a square or other polygonal shape, is positioned such that pivotal motion of the handle 16 will cause contact with one or more of the switches 30. An actuator having a greater number of sides and a corresponding increased number of switches, may be used to increase resolution of movements made by the shaft. The non-axially loaded, freely rotatable actuator of the presently preferred joystick 10 not only provides the advantage of avoiding undesirable switch actuation when the handle 16 is rotated, but also presents an economical and efficient device from a manufacturing standpoint by reducing the number of components and thus the steps required to assemble the joystick.

It is intended that the foregoing detailed description be regarded as illustrative rather than limiting, and that the following claims, including all equivalents, define the scope of the invention.

I claim:

1. In a joystick comprising a base, a plurality of switches disposed on the base, a shaft pivotally mounted to the base, the shaft having a handle end and an actuator end, the improvement comprising:

a shaft pivot assembly positioned coaxially on a portion of the shaft;

the shaft pivot assembly having a biasing member held in an axially fixed location by a first retaining member positioned on the shaft;

an actuator disposed on the actuator end of the shaft between the first retaining member and a second retaining member positioned in a fixed axial position on the shaft;

wherein the actuator has an axial dimension smaller than an axial dimension defined by a distance between the first and second retaining members, whereby the actuator is rotatable independent of rotation of the shaft.

2. The joystick of claim 1, wherein the shaft further comprises at least two annular grooves spaced apart on the shaft, the annular grooves positioned towards the actuator end of the shaft.

3. The joystick of claim 2, wherein the first and second retaining members are each sized to fit in a separate one of the at least two annular grooves.

4. The joystick of claim 1, wherein the first and second retaining members are E-rings.

5. The joystick of claim 1, wherein the biasing member is a spring.

6. The joystick of claim 1, wherein the actuator comprises a polygonal cross-section perpendicular to the axial dimension.

7. The joystick of claim 6, wherein the polygonal cross-section of the actuator comprises a square.

8. The joystick of claim 1, wherein the shaft pivot assembly further comprises a pivot member held against the base by a biasing force of the biasing member.

9. The joystick of claim 8, wherein the pivot member comprises a hollow sleeve mounted coaxially on a portion of the shaft.

10. In a joystick having a base, a plurality of switches disposed on the base, a shaft pivotally associated with the base, the shaft having a handle end and an actuator end, the improvement comprising:

a first axial retaining member attached to the shaft;

an actuator coaxially disposed on the shaft, the actuator having a central bore having a diameter greater than the diameter of the shaft; and a second retaining member affixed to the shaft on an opposite side of the actuator from the first retaining member, the actuator having an axial dimension less than an axial distance between the first and second retaining members.

* * * * *